United States Patent [19]

Raz

[11] Patent Number: 4,479,584

[45] Date of Patent: Oct. 30, 1984

[54] STORAGE AND DISPENSING MEANS FOR SANITARY COMMODITIES

[75] Inventor: Zeev Raz, Beer Sheva, Israel

[73] Assignee: Shilemay Plastics Products Ltd., Tel Aviv, Israel

[21] Appl. No.: 297,850

[22] Filed: Aug. 31, 1981

[51] Int. Cl.[3] ..... A47F 5/08

[52] U.S. Cl. ..... 211/89; 211/74; 211/51

[58] Field of Search ..... 211/89, 51, 60 R, 65, 211/67, 68, 69, 69.1, 60 A, 74; 206/45.14; 248/DIG. 5, 313, 224.3

[56] References Cited

U.S. PATENT DOCUMENTS

| | | | |
|---|---|---|---|
| 1,634,953 | 7/1927 | McCune et al. | 248/313 |
| 2,467,873 | 4/1949 | Weir | 211/74 |
| 2,642,191 | 6/1953 | Hobson | 211/89 |
| 2,812,563 | 11/1957 | Barber | 211/69.8 X |
| 2,923,414 | 2/1960 | Laughton | 211/51 X |
| 2,956,687 | 10/1960 | Robichaud | 211/65 |
| 3,055,508 | 9/1962 | Reeser | 211/51 |
| 3,215,387 | 11/1965 | Thompson et al. | 248/224.3 |
| 3,220,558 | 11/1965 | Olsson | 211/74 |

*Primary Examiner*—William E. Lyddane
*Assistant Examiner*—Peter A. Aschenbrenner
*Attorney, Agent, or Firm*—James & Franklin

[57] ABSTRACT

The invention provides a set of spring-like tongues for mounting in a compartment, for frictionally retaining differing objects, in particular sanitary commodities such as tampons, tampex cartridges and the like, comprising a plurality of juxtaposed spring-like tongues, longitudinally extending from a common head rail, which spring-like tongues are pre-bent in such a way that, starting from points adjacent to the head rail, they slope substantially away from the plane containing major surfaces of the head rail. The invention also provides a compartment for frictionally retaining and dispensing of differing objects incorporating such a set of spring-like tongues.

2 Claims, 6 Drawing Figures

STORAGE AND DISPENSING MEANS FOR SANITARY COMMODITIES

The present invention relates to a compartment for frictionally retaining and dispensing of differing objects, in particular, sanitary commodities such as tampons, tampex cartridges and the like. It also relates to a set of spring-like tongues for mounting in a compartment for frictionally retaining differing objects, in particular, sanitary commodities such as tampons, tampex cartridges and the like.

The storing of the above-mentioned articles has always posed a dilemma: how, on the one hand, to keep them ready for immediate use when needed, yet, on the other hand, by doing so, not to offend the tender susceptibilities of other members of the family, not to speak of the occasional house guest, or junior's class mates. A compromise solution was found in the ubiquitous bathroom cabinets. It appears, however, that, according to an as yet unnamed law, these cabinets are always untidy, full of rusty razor blades, discarded eyebrow pencils and hair curlers, etc., leaving very little room for such relatively bulky items as boxes of tampons and, given the usual state of these so-called sanitary cabinets, nobdy in his, or rather her, senses would entertain the idea of storing these tampons in the loose, unboxed state.

It is one of the objects of the present invention to overcome these and other problems and to provide a storage facility for sanitary or hygienic commodities which is adapted to the general size of these items as well as of their boxes, can be attached to suitable surfaces such as the inside surfaces of cabinet doors and will frictionally and simultaneously retain items of differing shapes and sizes such as tampon boxes and individual tampons of different sizes and diameters, keeping them well-ordered, clean, ready for use, yet completely separate from whatever else has found its final repose in the medicine chest or sanitary cabinet.

This the present invention achieves by proving a compartment for frictionally retaining and dispensing of differing objects, in particular, sanitary commodities such as tampons, tampex cartridges and the like, comprising at least a rear wall section, a bottom portion and a front wall, further comprising a set of juxtaposed spring-like tongues, the upper ends of which are immobilized and lie in a plane substantially coinciding with the plane of said rear wall, which spring-like tongues are pre-bent in such a way that, starting from their immobilized ends, they slope substantially away from said rear wall and towards said front wall, and end at points above said bottom portion but below the upper edge of said front wall, wherein an object can be pushed into said compartment only by flexing the sloping portion of at least one of said spring-like tongues back in direction towards said rear wall, whereby said object is frictionally retained in said compartment by the restoring force of said spring-like tongues clamping said object between the inside surface of said front wall and said flexed, spring like tongues.

It is a further object of the present-invention to provide a set of elastic retaining devices which can be attached to existing or otherwise available receptacles, to convert them thereby into storage facilities for the above-mentioned articles, and having the above-mentioned properties.

This the present invention achieves by providing a set of spring-like tongues for mounting in a compartment, for frictionally retaining differing objects, in particular, sanitary commodities such as tampons, tampex cartridges and the like, comprising a plurality of juxtaposed spring-like tongues longitudinally extending from a common head rail, which spring-like tongues are prebent in such a way that, starting from points adjacent to said head rail, they slope substantially away from the plane containing major surfaces of said head rail.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 6:
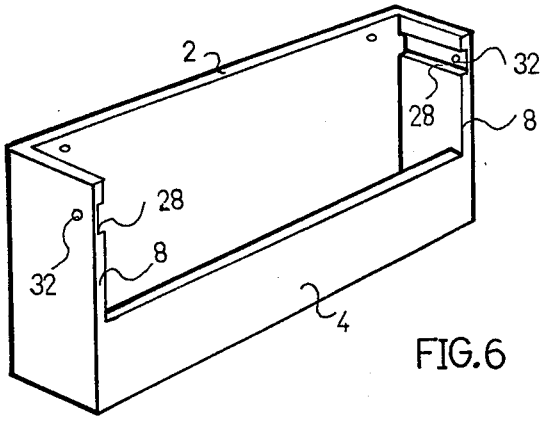
Figure 5:
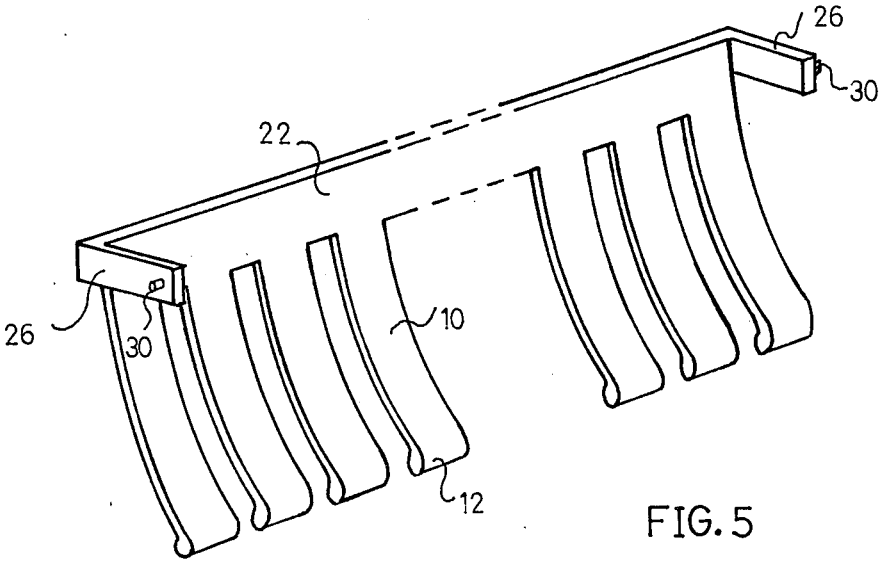

FIG. 5. is a perspective view of the set of spring-like tongues according to the invention, and FIG. 6 shows a perspective view of a compartment into which the set of FIG. 5 can be fitted.

Figure 1:
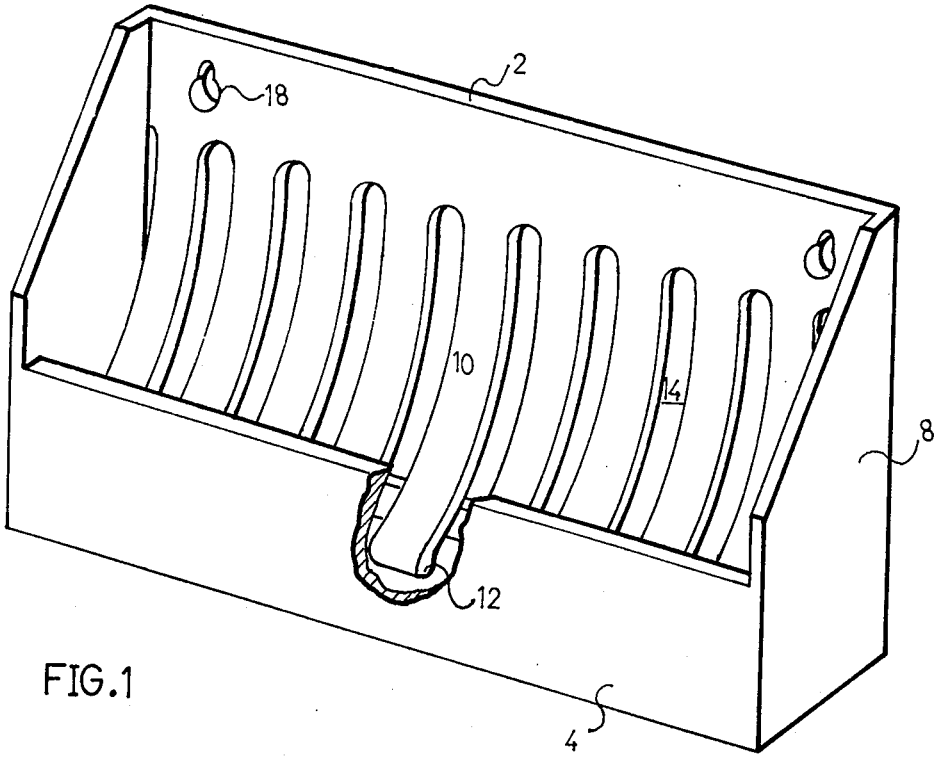
FIG. 1 is a perspective view of a preferred embodiment of the compartment according to the invention.
Figure 2:
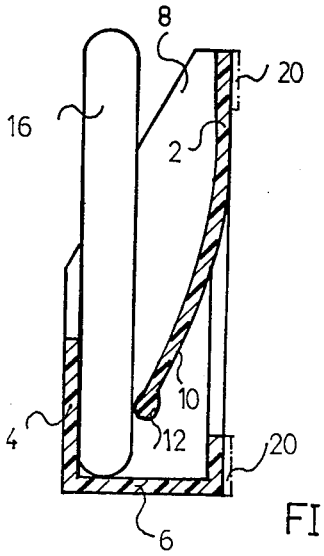
FIG. 2 is a side view, in cross section, of the embodiment of FIG. 1, showing also a tampon in position.

There is seen in FIGS. 1 and 2 a box-like compartment comprising a rear wall section 2, a front wall 4 which preferably is substantially lower than the rear wall section 2, a bottom portion 6 and two side walls 8. Further seen is a set of spring-like tongues 10. The upper ends of these tongues 10, being in this preferred embodiment integral with the rear wall section 2, are immobilized and lie in a plane substantially coinciding with the plane of the rear wall section 2 and are pre-bent in such a way that, from their upper, immobilized ends, they slope downwards, away from the rear wall 2, and towards the front wall 4. As seen to better advantage in FIG. 2, the lower ends 12 of the tongues 10 end at points above the bottom 6, but below the upper edge of the front wall 4. For the sake of clarity, the gaps 14 between the tongues 10 are drawn larger than necessary. The width of the tongues 10 is also optional and neither do the tongues have all to be of the same width.

The working principle of the compartment according to the invention is clearly understood from FIG. 2: an object, for instance, a tampon 16, can be pushed into the compartment only by flexing the sloping portion of at least one tongue 10 back in direction towards the rear wall 2, whereby the object is frictionally retained in the compartment by the restoring force of the spring-like tongues 10 clamping it between the inside surface of the front wall and the end section 12 of the flexed tongues 10. To prevent these ends 12 of the tongues from catching in, and damaging, the objects when the latter are withdrawn, they are rounded off or beaded.

The compartment can be mounted on walls or on the inside of cabinet doors. Holes 18 are provided for this purpose. For mounting on wall tiles or plastic surfaces, adhesive pads 20 can be provided.

Figure 3:
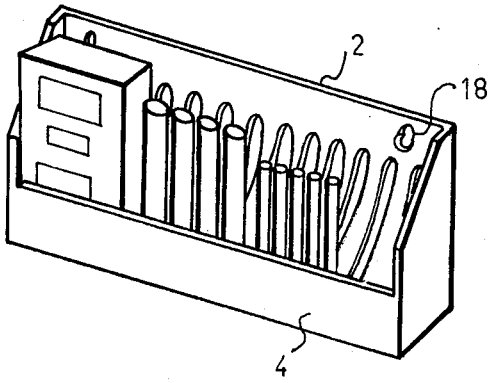
FIG. 3 is a perspective view of the compartment according to the invention, as filled with various sanitary commodities.

FIG. 3 illustrates the great advantage of the compartment according to the invention: it can simultaneously accommodate, and securely grip, a two-layer Tampex ® carton, a number of individual tampons of different diameters for immediate use and (not shown) an applicator.

While in the embodiment of FIG. 1 the spring-like tongues 10 are in fact an integral part of the compartment itself or at least of the rear wall 2, this is not necessarily the case in all embodiments envisaged.

Figure 4:
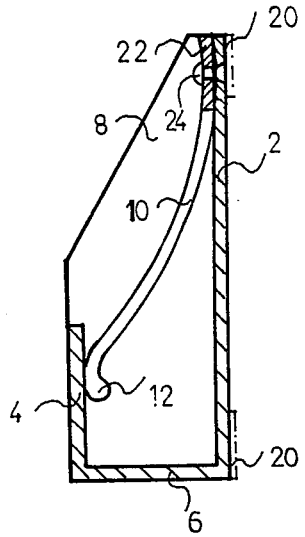
FIG. 4 shows a side view, in cross section, of another embodiment of the compartment according to the invention.

FIG. 4, for instance, shows an embodiment in which the set of spring-like tongues 10 is a separate part consisting of a common, horizontal head rail 22 from which, in the manner of the teeth of a comb, there extends a plurality of spring-like tongues 10. This rail and tongues unit, the length of which fits the inside width of the compartment, is fixedly attached to the rear wall 2, for instance, with the aid of rivets 24. Another embodiment of the separate attachable set of tongues 10 is seen in FIG. 5. The set is similar to that shown in FIG. 4, but is additionally provided with two lateral arms 26. The compartment adapted for this type of set is shown in FIG. 6 and is provided with shallow grooves 28 in the sidewalls 8. By appropriately flexing the head rail 22 after inserting the set of tongues into the compartment of FIG. 6, the lateral arms 26 can be made to snap into the grooves 28. For further securing, short projections 30 can be provided which drop into suitable holes 32 in the bottom of the grooves 28. The rear wall 2 can also be constituted by the inside surface of the door of a medicine chest or bathroom cabinet.

It should be specifically noted that the spring-like tongues described herein may have various configurations, other than those illustrated in the figures, and such functionally equivalent configurations are also intended to be included within the scope of the present invention.

Thus it will be evident to those skilled in the art that the invention is not limited to the details of the foregoing illustrative embodiments and that the present invention may be embodied in other specific forms without departing from the essential attributes thereof, and it is therefore desired that the present embodiments be considered in all respects as illustrative and not restrictive, reference being made to the appended claims, rather than to the foregoing description, and all changes which come within the meaning and range of equivalency of the claims are therefore intended to be embraced therein.

What is claimed is:

1. In a compartment for frictionally retaining and dispensing of different objects comprising at least a rear wall, a bottom portion, a front wall and a horizontally spaced pair of lateral side walls joining said rear and front walls and defining grooves on the facing surfaces thereof, and further comprising a set of juxtaposed spring like tongues the upper ends of which are immobilized and lie in a plane substantially coinciding with the plane of said rear wall and wherein an object can be pushed into said compartment only by flexing at least one of said spring like tongues back in a direction towards said rear wall, whereby said object is frictionally retained in said compartment by the restoring force of said flexed spring like tongues clamping said object between the inside surface of said front wall and said flexed spring like tongues, the improvement comprising providing a set of spring like tongues for frictionally retaining and dispensing sanitary commodities such as tampons, Tampax cartridges and the like, said spring like tongues being pre-bent in such a way that starting from their immobilized ends they gradually continuously curve substantially along their entire length away from said rear wall and toward said front wall and end at points substantially adjacent said front wall and below the upper edge thereof, the free ends of said spring like tongues being rounded off about an axis extending substantially across the width of said spring like tongues and forming a contact line parallel to said axis to prevent said free ends from catching in and damaging the surfaces of said sanitary commodities when the latter are withdrawn from said compartment by minimizing the contact area therebetween, said set including mounting means provided at its ends with arms extending substantially perpendicularly therefrom in a horizontal plane and adapted to be flexed to enter said grooves of said lateral compartment side walls.

2. A set of spring like tongues for mounting in a compartment, for frictionally retaining and dispensing sanitary commodities such as tampons, Tampax cartridges and the like, comprising a common mounting means disposed in a vertical plane and a plurality of juxaposed spring like tongues extending lengthwise from said common mounting means, which spring like tongues are pre-bent in such a way that starting from points adjacent to said mounting means, they gradually continuously curve substantially along their entire length away from the vertical plane of said mounting means, the free ends of said spring like tongues being rounded off about an axis extending substantially across the width of said tongues and forming a contact line parallel to said axis to prevent said free tongue ends from catching in and damaging the surfaces of said sanitary commodities when the latter are withdrawn from said compartment by minimizing the contact areas therebetween, said mounting means being provided at its ends with arms extending substantially perpendicularly therefrom in a horizontal plane and adapted to be flexed to enter grooves in lateral sidewalls of said compartment.

* * * * *